United States Patent [19]

Degen

[11] 4,222,134

[45] Sep. 16, 1980

[54] UNDER-MATTRESS FOR BEDS OR SIMILAR ARTICLES OF FURNITURE

[75] Inventor: Hugo Degen, Seltisberg, Switzerland

[73] Assignee: Marpal AG, Chur, Switzerland

[21] Appl. No.: 945,965

[22] Filed: Sep. 26, 1978

[30] Foreign Application Priority Data

Sep. 30, 1977 [CH] Switzerland ..... 12002/77

[51] Int. Cl.[2] ..... A47C 23/06

[52] U.S. Cl. ..... 5/191; 3/238

[58] Field of Search ..... 5/190–192, 5/234, 236–238, 240; 160/237; 267/80, 110, 112, 142; 297/283

[56] References Cited

U.S. PATENT DOCUMENTS

| | | | |
|---|---|---|---|
| 589,239 | 8/1897 | Bent | 5/236 |
| 3,176,323 | 4/1965 | Degen | 5/238 |
| 3,813,713 | 6/1974 | Kiptier | 5/191 |
| 4,106,140 | 8/1978 | Kievits | 5/191 |

*Primary Examiner*—Casmir A. Nunberg

*Attorney, Agent, or Firm*—Neil F. Markva

[57] ABSTRACT

An under-mattress for a bed or similar article of furniture comprises a frame having two longitudinal limbs with elastic support elements attached to the inside thereof. The elastic support elements are located opposite each other in pairs for supporting spring bridges 3 disposed transversely of the mattress. Each spring bridge has formed therein at least one slot-like recess A extending longitudinally of the bridge and dividing it over a large portion of its length into parallel spring laths.

18 Claims, 20 Drawing Figures

1
2
3
3a
3b
3c
4
5
6
7
8
8a
9
10
11
12
19
19a
A
L'
M

UNDER-MATTRESS FOR BEDS OR SIMILAR ARTICLES OF FURNITURE

FIELD OF THE INVENTION

The invention relates to an under-mattress for a bed or similar article of furniture. Such an under-mattress may comprise a frame having two longitudinal limbs to the inside of which are attached elastic support members disposed opposite each other in pairs for supporting resilient bridges which are arranged in the transverse direction to the longitudinal axis of mattress.

BACKGROUND OF THE INVENTION

For approximately one and a half decade, under-spring arrangements for beds have been on the market by means of which an anatomically improved reposing surface has been attained relative to the old conventional coil spring frames. Such arrangements include resilient wooden laths disposed transverse to the longitudinal body axis and retained at their two ends in support members which consist of an elastic material and are therefore able to move flexibly, i.e., to follow the body contour. These beds constitute an advance compared with all earlier systems and even in relation to those which have a rigid lateral bearing. Preponderantly, upper mattresses of foamed material are used as upper covers for such lath-type under-spring arrangements.

Owing to their inherent spring properties, as well as their ability to retain heat, these upper mattresses are very suitable. However, endeavors must be made to render the pressure support area as large as possible. The lath-spring arrangement causes some difficulties. A spring lath requires a certain thickness in order to maintain its stability but it must exhibit a certain carrying power which can then be regulated only by varying the width of the spring lath in the systems known heretofore.

Conventional bed-like articles of furniture commercially obtainable at present are furthermore known to form a functional unit of different co-operating systems. These known structures admittedly afford character to the bed-like article of furniture as a whole, but must be constructed and built in individually and also become effective separately when in use. Accordingly, there are differentiated in the usual bed-like articles of furniture inter alia (1) the support system which effects the resilient mounting of the transverse laths, (2) the possibility of regulating the hardness (spring characteristic) of the transverse laths (e.g. in the case of overweight), and (3) devices for adjusting the height of individual groups of transverse laths (lumbar or shoulder portions), wherein heretofore the step-less height regulation of individual transverse laths (for orthopaedic use at any desirable location) of the bed-like article of furniture was not realizable.

Every single one of these three systems was developed further from relatively primitive beginning in the course of the last two decades, with constant improvement of the lying and sleeping comfort. However, there has been no success in combining the three-fold operational effect in a single system.

Considered from the two-fold point of view of load absorption and ventilation, the spring lath arrangement of a bed-like article of furniture must be adjusted to two mutually contradictory criteria. For a given lath thickness, the spring lath must be as wide as possible in view of the absorption of large forces and the avoidance of excessive bending-through. However, the lying surface is well ventilated when narrow laths are selected which have large gaps providing access for air.

Since the specific pressure absorption and bending ability of a spring lath is substantially determined by the thickness thereof and the latter constitutes a given quantity in the selection of the spring lath parameters, the constructor of the bed-like article of furniture still has the selection of the width and the mutual spacings of the spring laths. Here, however, the two-fold criterium referred to above sets a clear limit. Thus, in most cases, the bed-like articles of furniture known heretofore were either badly ventilated or possessed insufficient support properties.

SUMMARY OF THE INVENTION

According to the invention, an under-mattress for a bed or similar article of furniture comprises a frame having two longitudinal limbs with elastic support elements attached to the inside thereof. The support elements are located opposite each other in pairs for supporting spring bridges arranged in a direction transverse to the longitudinal axis of the under-mattress. Each spring bridge comprises at least one slot-like recess extending in the longitudinal direction of the bridge and divides the spring bridge at least over a large portion of its total length into parallel spring laths.

A preferred under-mattress for lie-on and sit-on articles of furniture combines the three functions of support and the stepless regulation of height and hardness in a single system. Furthermore, there is a wide range of variation for the adjustment to individual requirements and the support surface supporting an upper mattress may be divided. This ensures a satisfactory ventilation and a support characteristic to satisfy all demands.

An undermattress according to this invention differs even by the problem set from all construction types of the bed-like articles of furniture known heretofore in an essential respect. The known elastic support members realize merely an elastic supporting and counter-holding function, which in the best case adjusts itself to the body shape. However, a triple main function is provided in the new support element. The main function is supplemented furthermore by further secondary auxiliary functions which, considered as a whole, are not unimportant. The new elastic support element

- supports the resting or sleeping body on a wide yet well ventilated cover in an elastic manner, in that it adjusts itself automatically to the body shape and body positions which changes during sleep,
- permits the stepless regulation of the spring characteristic of each individual spring bridge over a wide control range, and
- furthermore, according to a preferred variant, may be so constructed that each individual spring bridge per se is vertically adjustable to a considerable extent and thus may be easily adjusted to the natural body depressions, as well as body portions to be especially lifted, of patients.

These three main functions which are realized in a single constructional system, i.e. the divided spring bridge, are supplemented by further advantages, such as e.g. the broader support surface of the upper mattress, the avoidance of wide gaps in which portions of the upper mattress are harshly treated, and the efficient ventilation.

BRIEF DESCRIPTION OF DRAWINGS

The invention will be further described, by way of example, with reference to the accompanying drawings, in which.

DETAILED DESCRIPTION

Figures 1, 2, 3, 4, 5:
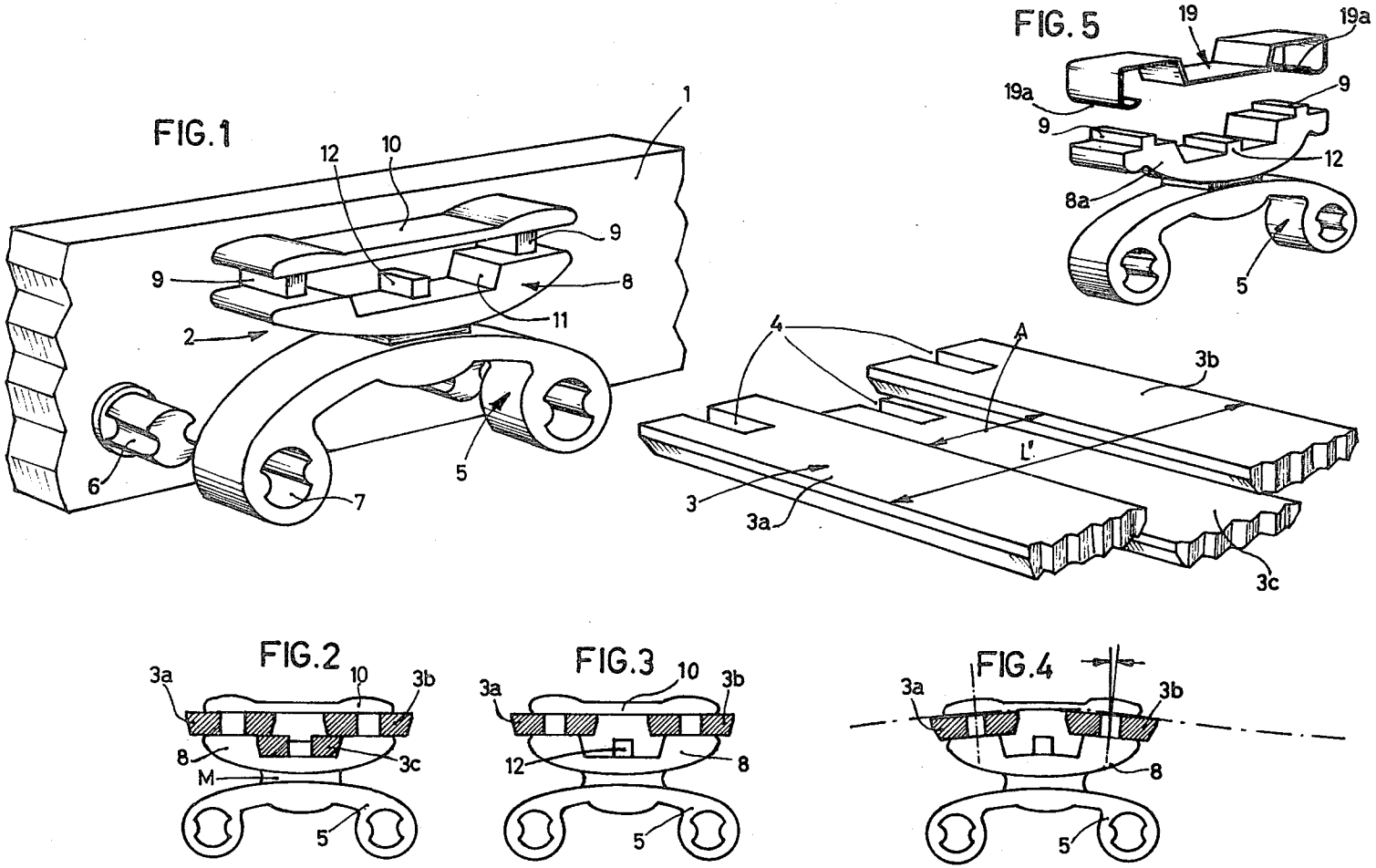
FIG. 1 illustrates, with reference to a perspective partial illustration of the new under-mattress, a spring bridge prior to the assembly thereof.
FIGS. 2 to 4 are vertical sections of an elastic support element.
FIG. 5 illustrates in perspective a constructional variant of the elastic support element.
Figure 6:
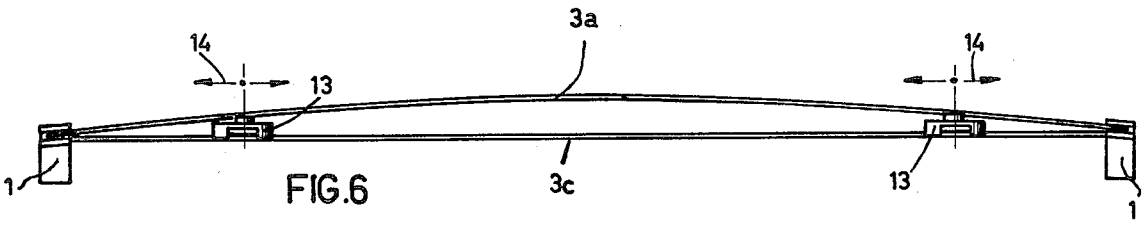
FIG. 6 is a vertical section through a spring bridge transversely to the longitudinal axis of the under-mattress.
Figure 7:
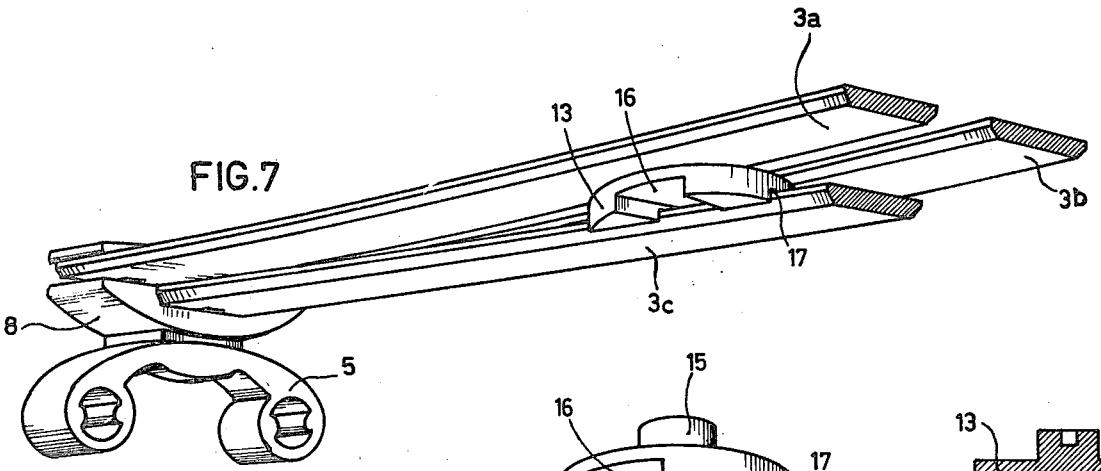
FIG. 7 illustrates a spring bridge in a perspective view from below, after the assembly thereof.

As shown in FIG. 1, an elastic support element 2 is attached to a longitudinal limb 1 of a bed-like article of furniture and serves in turn for the elastic support of a spring bridge 3 which consists of three spring laths 3*a*, 3*b*, and 3*c*. At their two ends, the spring laths 3*a*, 3*b*, and 3*c* comprise a respective central groove 4 by means of which each may be anchored in two identical support elements 2.

The spring bridge 3 associated with each pair of support elements 2 thus possesses a recess A (FIG. 1) which separates the spring laths 3*a* and 3*b* from each other and which in the constructional form described extends over the entire length of the spring laths 3*a* and 3*b*. According to a modification, it would also be possible for the two spring laths 3*a* and 3*b* to be connected together at their ends and thus for the recess A to extend merely over a large portion of the spring lath length. Each elastic support element 2 comprises a lower portion 5 which is anchored in a known manner on two pins 6 which project laterally from the longitudinal limb 1 and which extend into openings 7. The lower portion 5 which is convexly curved in the upward direction supports a spring lath support 8 which has a convexly downwardly curved face extending toward the lower portion 5. In their common region, lower portion 5 and spring lath support 8 are connected together by a zone M, preferably produced in one piece, and form a kind of double rocker, the multiple functioning of which will be explained in the following description. The spring lath support 8 comprises two substantially brick-shaped elastic cams 9 disposed in the same horizontal plane and serve as holder elements for the spring laths 3*a* and 3*b*. Cams 9 are connected together in their upper region by a cover band 10. During assembly, the grooves 4 of two spring laths 3*a* and 3*b* are pushed over cams 9 and the laths are then securely fixed therein.

Thus spring lath support 8 consists of an elastic work material, preferably rubber, mounted on lower portion 5 to perform rocking movements parallel to the adjacent side face of the longitudinal limb 1, therefore, able to rotate to a limited extent about the longitudinal axis of the spring bridge 3. Thanks to its multiple movement possibilities, spring lath support 8 can adjust itself to any desired loading and can intercept the same by a corresponding elastic reaction. This elastic automatically adjusted reaction is of importance for the desired adjustment of the support system to be obtained in respect of the load conditions which differ from lying zone to lying zone.

In contrast to the known spring lath systems, a broad support surface is produced here thanks to the subdivision of the known spring lath into two spring laths for the upper mattress, with the spacing remaining the same and the spring resistance remaining the same. Yet owing to the gap between the spring laths 3*a*, and 3*b*, the support surface permits a satisfactory ventilation. As is clearly evident from the drawings, each parallel spring lath of the disclosed invention is independently flexible vertically with respect to the longitudinal axis of the under-mattress. Moreover, the cover material of the upper mattress is carefully treated because the spacing of the spring laths 3*a, and 3b* is relatively small. Furthermore, the mutual spacings of two adjacent spring bridges 3 can also be made smaller compared with the known systems, so that the risk of hard use of the mattress materials is reduced.

According to a constructional variant, the two holder cams 9 may be inclined slightly, e.g. by 2° to 7°, towards the central axis of symmetry of the support element 2, so that under load they assume the vertical position according to FIGS. 2 and 3. However, in the practical loading case, each spring bridge will adjust itself individually dependently upon the magnitude and the angle of attack of the load (see for example FIG. 4). The two spring laths 3*a* and 3*b* of the same spring bridge may even react differently without difficulty depending upon the loading.

FIG. 1 shows spring lath support 8 in its middle region comprises a groove 11 in the center of which a further holder cam 12 is disposed. Thanks to this measure, the third spring lath 3*c* may be anchored underneath the two spring laths 3*a* and 3*b* to provide the spring bridge 3 with a series of further adjustment possibilities.

Owing to the provision of this additional third spring lath 3*c*, the hardness of the under-mattress may be changed at will at any desired location. However, by means of a further constructional variant not only a further hardness adjustment, but also a height regulation of the spring bridge 3, such as illustrated by FIGS. 6 to 9, may be obtained. For this purpose, two spacing changers 13 are so arranged between the two upper spring laths 3*a* and 3*b* and the lower spring lath 3*c* that they may be displaced towards or away from each other in the direction of the double arrows 14. The spacing changers 13 consist preferably of a slippery synthetic resin. Upon displacement thereof, the two upper spring laths 3*a* and 3*b* are raised more as the spacing changers approach their extreme outer positions according to FIG. 6.

The spacing changers 13 are so constructed that they are located astride the lower spring lath 3*c* and are guided thereon as also in the gap between the two upper spring laths 3*a* and 3*b*. In the illustrated constructional form, each spacing changer 13 comprises a guide pin 15, which projects upwardly between the two spring laths 3*a* and 3*b* and includes two guide grooves 16 and 17 which cross at right angles and are disposed in planes at different heights. If, for example, spacing changer 13 is guided on the lower spring lath 3c by means of the guide groove 16, a further height adjustment of the spring bridge may be obtained by simple re-location through 90°.

Figure 8:
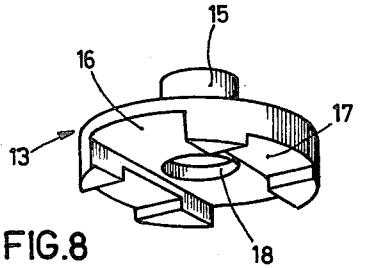
FIGS. 8 and 9 illustrate a constructional form of a spacing changer serving for adjusting the height and/or the hardness of the spring bridge.
Figure 9:
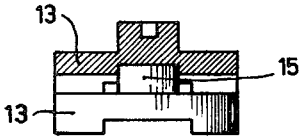

An additional possibility of height regulation and individual hardness adjustment of each individual bridge may also be obtained according to FIGS. 8 and 9. Here, spacing changers 13 are constructed to be stacked one on top of the other and for this purpose each comprises on its underside a bore 18 into which pin 15 can be fitted. In this way, two or more spacing changers 13 may be stacked one on top of the other as shown in FIG. 9. Moreover, a displacement of spacing changers 13 will always bring about a combined adjustment of the height and the hardness of the spring bridge. The smallest influence on the spring hardness with simultaneously the highest possible height position is obtained by the extreme position according to FIG. 6 in which the spacing changers 13 have their greatest mutual spacing.

Relatively to the underside of the two upper spring laths 3a and 3b, the lower receiving surface of the groove 11 is displaced downwardly at most by the thickness dimension of the spring lath 3c. Preferably this dimension which is determined for receiving the third spring lath 3c is kept slightly smaller than the thickness of the spring lath. Thereby the third lower spring lath 3c is clamped in the groove 11 and accordingly exerts a steady pressure on the section of the spring lath support 8 disposed therebelow. Thus, spring lath support 8 is hardened in itself and yields less to the loads acting thereon perpendicularly or obliquely.

However, by clamping the third spring lath 3c, it is also attained that the two upper spring laths 3a and 3b, indeed the entire spring bridge, form a compact unit. Whereas the two upper spring laths 3a and 3b may normally react even independently of each other to different engaging forces, they are functionally coupled together by the clamping and tensioning forces which are exerted by the lower spring lath 3c. This may be of importance for certain orthopaedic applications for the purpose of local increase of the spring hardness.

The construction described may be modified in many ways by the expert. Thus, for example, it may be possible to provide the spring lath support 8 (FIG. 1) with a separate protective buckle 19 (FIG. 5) which takes the place of the cover band 10, with a view to a different kind of assembly of the spring laths. The protective buckle 19 is provided at its ends with holder loops 19a which embrace the correspondingly shaped edge portions of the spring lath support 8a. In this variant, the ends of the spring laths 3a and 3b may thus be placed from above upon the cams 9 and then be fixed by means of the protective buckle 19.

Figure 10:
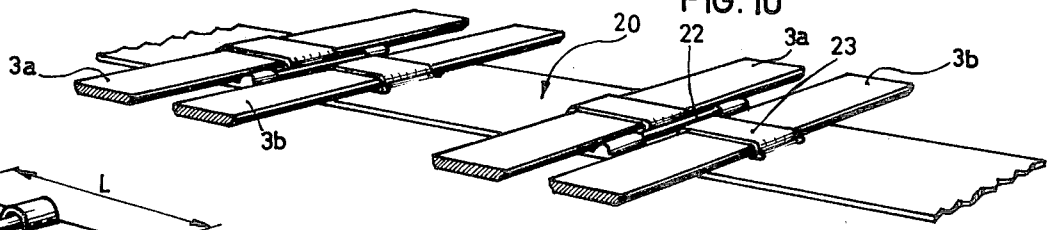
FIGS. 10 to 16 illustrate the construction and assembly of a stabilizing belt.
Figure 11:
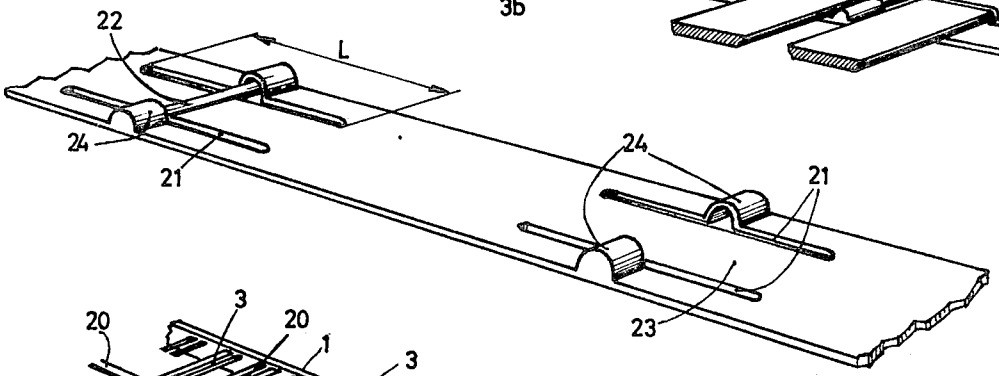

In order to compensate the elastic reaction forces of the support elements 2, to obtain a certain synchronization of the elastic reaction of two adjacent spring laths, and also to permit the desired counter-spring and return forces to become effective in the middle region of the spring laths, a stabilizing belt 20 may be advantageous. According to a constructional form shown in FIGS. 10 to 12, a belt 20 is produced from rubber and in the region of each spring bridge includes two slots 21 parallel to its longitudinal axis and having length L which corresponds approximately to the upper total width L' (FIG. 1) of spring bridge 3. As illustrated in FIG. 10, the two spring laths 3a and 3b after insertion through the two slots 21, are resiliently retained by a pin 22 pushed above the belt tongue 23 located between the slots 21 through two laterally diposed eyes 24.

Figure 12:
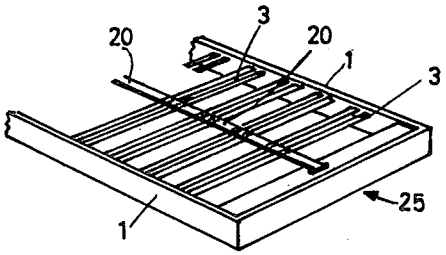
Figure 13:
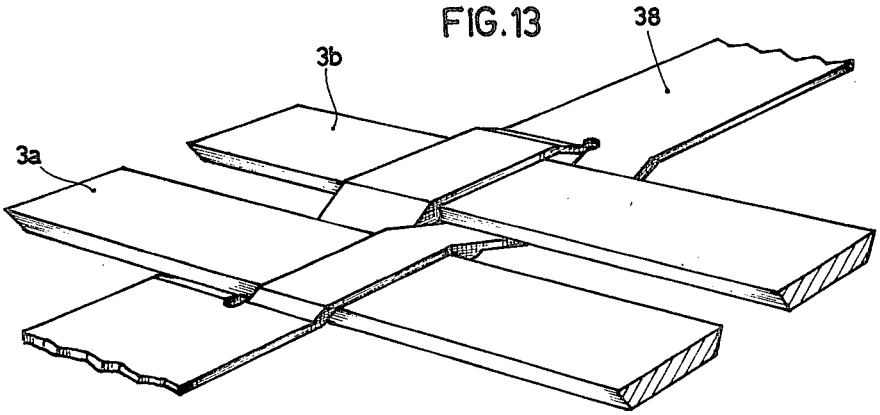
Figure 14:
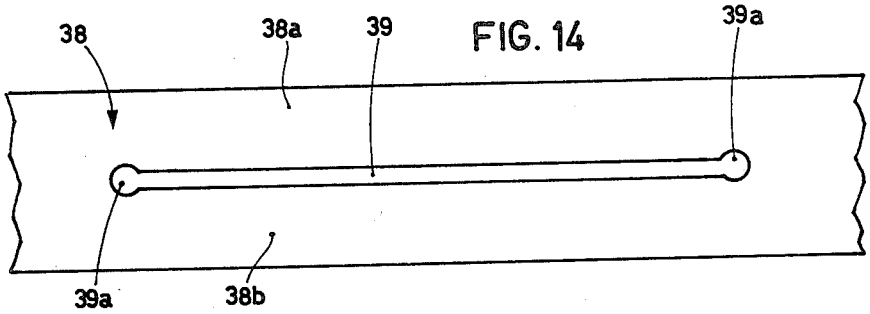

FIG.12 illustrates the mounted stabilizing belt 20 at the lower mattress 25. In the illustrated constructional form, pin 22 is cylindrical. The two spring laths 3a and 3b arranged on both sides of pin 22 move again and again and may be subjected to different size and differently directed forces. Thus the belt tongue 23 rolls slightly on the pin 22 at each mutually relative angular movement of the spring laths, so that the friction occurring is kept very small.

The belt construction according to FIGS. 10 and 12 constitutes merely a contructional example which may be varied in various ways. Thus it would be possible to stamp out one or more belt tongues 23 for each spring lath 3a and 3b, in order to retain thereby the spring laths in an elastic manner without additional protective elements 22.

A further constructional form of the stabilizing belt is illustrated by FIGS. 13 to 16. According to this constructionally uncomplicated and yet functionally very effective variant, belt 38 includes at its crossing point with the two spring laths 3a and 3b a longitudinal slot 39 which is located in its center axis. In this case, the two spring laths 3a and 3b are guided by slot 39 in such a manner that they engage alternately over and under one of the belt sections 38a and 38b, respectively, limiting the slot. By appropriate dimensioning of the length of the slot 39 a secure elastic embrace of the spring laths and a secure spacing maintenance as well as elastic stabilization of the same can be obtained. In order to counter the risk of tearing out, the slot 39 is limited at each end by a respective rounded enlargement 39a.

Figure 15:
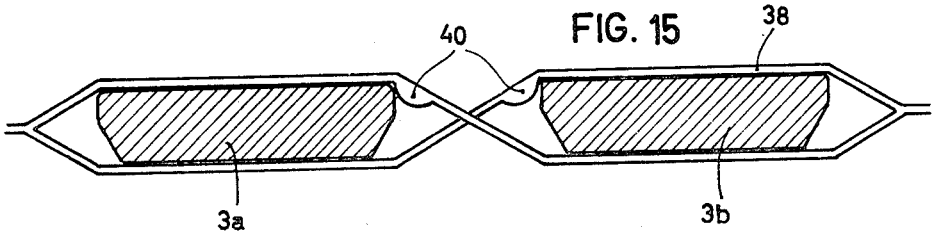
Figure 16:
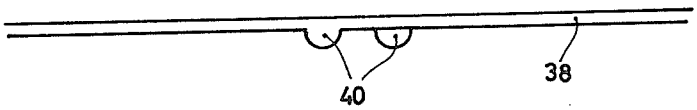

Furthermore, as illustrated in FIGS. 15 and 16, the belt sections 38a and 38b may include cams 40 on their undersides in the crossing region. Cams 40 abut the adjacent edges of the spring laths 3a and 3b and contribute to the further improvement of the stability and spacing maintenance.

Figure 17:
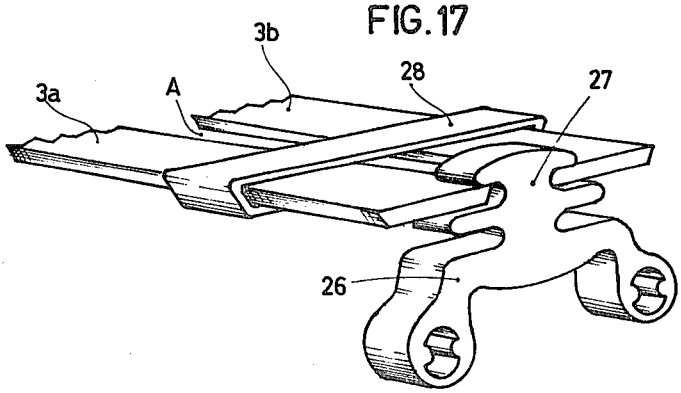

According to FIG. 17 the inventive idea may be realized even in a relatively simple constructional example. The known profile 26 (see CH-PS 388, 561) includes rail 27 abutted on both sides by a respective spring lath 3a and 3b. The two spring laths are retained at the rail 27 by a clip 28. The recess A located between the spring laths 3a and 3b corresponds in this case to the width of the rail 27. The clip 28 may consist for example of a synthetic resin or steel. Obviously it would not be any difficulty for the expert to design in place of the clip construction illustrated another holder member for the two spring laths.

Figure 18:
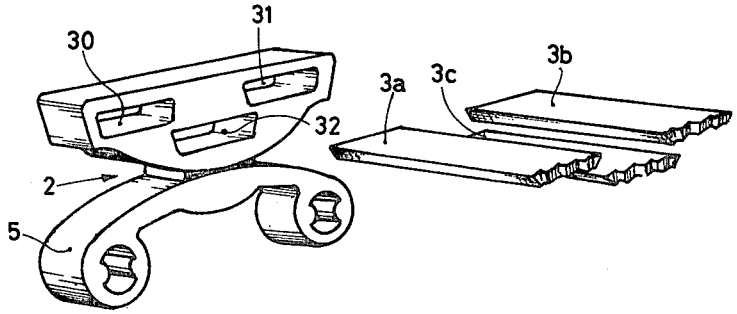
FIGS. 17 to 20 illustrate constructional variants.

FIG. 18 illustrates a variant of the support elements 2 illustrated in FIG. 1. While the lower portion 5 has remained the same, the spring lath support 29 includes three pockets 30, 31, 32 for receiving the spring laths 3a, 3b, 3c. The cross-section of these pockets is preferably maintained slightly smaller than the cross-section of the spring laths to elastically clamp the end sections of the spring laths. This support element 2 consists of elastic material, preferably rubber, and may be either extruded in one piece, or put together from a plurality of parts.

Figure 19:
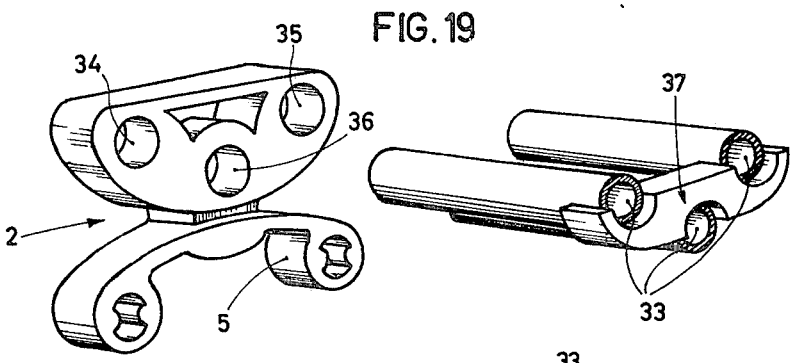

Furthermore, as illustrated in FIG. 19, support element 2 may even be constructed to receive tubular spring elements 33. For this purpose, three circular cylindrical pockets 34, 35, and 36 accommodate tubular spring elements 33 having ends which may be pressed into them. The tubes 33 may consist of a plastics material or wood and, in accordance with a further variant, in place of the tubes alternatively solid rods of wood or plastics material with a circular, oval or any polygonal cross-section may be used.

Figure 20:
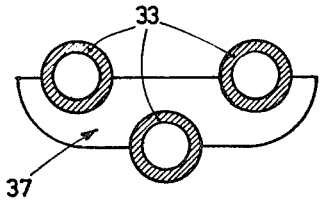

A pair of spacing changers 37 may be with the cross-section shown in FIG. 20. In this case, spacing changers 37 may be slidingly displaced at the outer surfaces of the tubular spring elements 33. Thus the hardness and the height of the spring bridge may be regulated in the manner previously described.

The expert will be able to amplify the idea of the invention further in various respeccts, without exceedng the protection scope defined in the patent claims. Thus for example the support elements 2 may alternatively be produced in two parts and the two parts connected together in their middle region.

The three spring laths 3*a*, 3*b*, and 3*c*, may differ from each other fundamentally in respect of width, thickness and profile while in accordance with a preferred embodiment, they possess the same dimesions.

When a plurality of such spring is used in place of the two upper spring laths 3*a*, 3*b*; two or more recesses A would be located between the laths.

I claim:

1. An undermattress for a bed-like article of furniture having a longitudinal axis, said under-mattress comprising:

(a) a frame having two longitudinal limbs with insides, (b) elastic support elements, and (c) spring bridges each having at least one slot-like recess extending along its length and defining parallel spring laths laterally spaced with respect to each other at least over a large portion of the total length of each spring bridge, (d) said elastic support elements being attached to said insides of said longitudinal links in pairs and located opposite each other for supporting said spring bridges which are arranged transversely to said longitudinal axis of said under-mattress, (e) each support element possesses a lower portion which is mounted on two pins projecting laterally at the longitudinal limb of the bed-like article of furniture, (f) the upwardly facing outer surface of said lower portion being curved convexly upwardly and having a middle region supporting a downwardly convexly curved spring lath support which is constructed in the manner of a rocker, (g) said spring lath support comprises at least two holder elements serving for anchoring the ends of said spring laths.

2. An under-mattress as set forth in claim 1, wherein a further holder element for a third spring lath is arranged between said two holder elements and is downwardly offset by at most the thickness of one spring lath, said third spring lath thus being located symmetrically in respect of the longitudinal axis of said spring bridge underneath said two first-mentioned spring laths and said ends thereof projecting into a respective groove of corresponding width of said spring lath support.

3. An undermattress as set forth in claim 1, wherein a further holder element for a third spring lath is arranged between said two holder elements and is downwardly offset by at most the thickness of one spring lath, said third spring lath thus being located symmetrically in respect of the longitudinal axis of said spring bridge underneath said two first-mentioned spring laths and said ends thereof projecting into a respective groove of corresponding width of said spring lath support, said third spring lath serves as a support for two freely slidingly displaceable spacing changers, each of these spacing changers comprises a guide pin which extends upwardly into said recess between said two upper spring laths, the underside of each guide pin has at least one guide groove adjusted to the profile of said lower spring lath so that the spacing changers may be displaced in the gap between said two upper spring laths and said third lower spring lath as may be desired for the adjustment of the height or the hardness of said spring bridge, each spacing changer comprising on its underside two guide grooves which cross each other at right angles and are disposed in planes of different height and on its underside a central bore the diameter of which is at least equal to that of the guide pin so that two or more spacing changers may be stacked one on top of the other.

4. An undermattress as set forth in claim 1, wherein said holder elements of said spring lath support are constructed as substantially brick-shaped elastic cams and are connected together at their upper portions by a cover element which extends substantially over the entire length of said spring lath support, said cover element projects on both sides beyond said two holder cams to serve as an upper holder of said spring lath end sections, said cover element being constructed as a releasable buckle which possesses at its ends securing means for anchoring both ends at said spring lath support.

5. An undermattress for a bed-like article of furniture having a longitudinal axis, said under-mattress comprising:

(a) a frame having two longitudinal limbs with insides, (b) elastic support elements, and (c) spring bridges each having at least one slot-like recess extending along its length and defining parallel spring laths laterally spaced with respect to each other at least over a large portion of the total length of each spring bridge, (d) said parallel spring lath being independently flexible vertically with respect to said longitudinal axis, (e) said elastic support elements being attached to said insides of said longitudinal limbs in pairs and located opposite each other for supporting said spring bridges which are arranged transversely to said longitudinal axis of said under-mattress.

6. An under-mattress as set forth in claim 5 wherein each spring bridge is divided by a central continuous recess into two mutually separate spring laths the end sections of each two mutually separate spring laths anchored at the upper portion of a single pair of said support elements.

7. An under-mattress as set forth in claim 6 wherein at least one stabilizing belt is arranged in said longitudinal direction of said bed-like article of furniture said belt overlies all said spring bridges and connects them together elastically.

said stabilizing belt includes two parallel slots in the region of each spring bridge which slots extend over the upper total width of said spring bridge, the edge sections remaining in said middle region of said slots of the stabilizing belt, an eye means disposed on each edge section to freely rotatably accommodate a cylindrical retaining pin.

8. An under-mattress as set forth in claim 6 wherein at least one stabilizing belt is arranged in the longitudinal direction of said bed-like article of furniture which overlies all said spring bridges and connects them together elastically, said stabilizing belt includes at its crossing point with said two spring laths a longitudinal slot located in its center axis, said spring laths being guided through the longitudinal slot in such a manner that they engage alternately under and over, respectively, one of said belt sections limiting said longitudinal slot.

9. An under-mattress set forth in claim 8 wherein at least one cam is disposed on the undersides of said belt sections in the region of said crossing point, each cam abuts the edge of a respective one of said spring laths.

10. An under-mattress as set forth in claim 5 wherein said support elements include a spring lath support having pockets formed therein.

11. An under-mattress as set forth in claim 10 wherein said spring laths are constructed as tubes composed of wood or plastics.

12. An under-mattress as set forth in claim 5 wherein each support element has a rail with opposite grooved sides and two mutually separate spring laths are held against said opposite grooved sides of the rail of each support element by at least two clips.

13. An under-mattress as set forth in claim 6 wherein each support element includes a lower portion mounted on two pins projecting laterally at the longitudinal limb of the bed-like article of furniture, said lower portion has an upwardly facing outer surface which is curved convexly upwardly and has a middle region supporting a downwardly convexly curved spring lath support.

14. An under-mattress as set forth in claim 13 wherein a further holder element for a third spring lath is arranged between said two holder elements and is downwardly offset by at most the thickness of one spring lath, said third spring lath thus being located symmetrically in respect of said longitudinal axis of said spring bridge underneath said two first-mentioned spring laths and said ends thereof projecting into a respective groove of corresponding width of said spring lath support.

15. An under-mattress as set forth in claim 13 wherein a further holder element for a third spring lath is arranged between said two holder elements and is downwardly offset by at most the thickness of one spring lath, said third spring lath thus being located symmetrically in respect of said longitudinal axis of said spring bridge underneath said two first-mentioned spring laths and said ends of said third spring lath projecting into a respective groove of corresponding width of said spring lath support, said third spring lath serves as a support for two freely slidingly displaceable spacing changers.

16. An under-mattress as set forth in claim 15 wherein each spacing changer includes two guide grooves which cross each other at right angles and are disposed in planes of different height on its underside.

17. An under-mattress as set forth in claim 16 wherein a central bore is located on the underside of the spacing changer and has a diameter at least equal to that of the guide pin located on the top side of the spacing changer so that two or more spacing changers may be stacked one on top of the other.

18. An under-mattress as set forth in claim 13 wherein each said support element has at least two holder elements to anchor the ends of the spring laths, said holders of said support elements are constructed as substantially brick-shasped elastic cams and are connected together at their upper portions by a cover element which extends substantially over the entire length of said support element.

* * * * *